US011814758B2

(12) United States Patent
Berrian et al.

(10) Patent No.: US 11,814,758 B2
(45) Date of Patent: Nov. 14, 2023

(54) UPPER INCLUDING A KNITTED COMPONENT

(71) Applicant: NIKE, Inc., Beaverton, OR (US)

(72) Inventors: Travis J. Berrian, Portland, OR (US); Bryan N. Farris, North Plains, OR (US); Adrian Meir, Portland, OR (US); Noah Murphy-Reinhertz, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/902,137

(22) Filed: Sep. 2, 2022

(65) Prior Publication Data

US 2023/0051338 A1 Feb. 16, 2023

Related U.S. Application Data

(63) Continuation of application No. 17/001,275, filed on Aug. 24, 2020, now Pat. No. 11,447,899, which is a (Continued)

(51) Int. Cl.
*D04B 1/24* (2006.01)
*D04B 1/10* (2006.01)
(Continued)

(52) U.S. Cl.
CPC ..... *D04B 1/24* (2013.01); *A43B 1/04* (2013.01); *A43B 11/00* (2013.01); *A43B 23/042* (2013.01);
(Continued)

(58) Field of Classification Search
CPC ... D04B 1/12; D04B 1/14; D04B 1/22; D04B 1/123; D04B 1/94; D04B 7/38;
(Continued)

(56) References Cited

U.S. PATENT DOCUMENTS 8,448,474 B1 5/2013 Tatler et al.
8,621,891 B2 1/2014 Dua et al.
(Continued)

FOREIGN PATENT DOCUMENTS

EP 2792260 A2 10/2014

OTHER PUBLICATIONS

Intention to Grant received for European Patent Application No. 17804400.4, dated Oct. 28, 2022, 7 pages.
(Continued)

*Primary Examiner* — Danny Worrell
(74) *Attorney, Agent, or Firm* — SHOOK, HARDY & BACON L.L.P.

(57) ABSTRACT

An upper for an article of footwear may include a knitted component that includes a first zone, a second zone, and a third zone. Each of the first zone, the second zone, and the third zone may extend toward a collar area of the upper at least partially in a heel area of the upper. The second zone is located between the first zone and the third zone such that the second zone is located in a substantially central portion of the heel area. The second zone may include an elasticity that is greater than an elasticity of the first zone and also greater than an elasticity of the third zone.

16 Claims, 5 Drawing Sheets

Related U.S. Application Data continuation of application No. 15/808,342, filed on Nov. 9, 2017, now Pat. No. 10,753,019.

(60) Provisional application No. 62/421,850, filed on Nov. 14, 2016.

(51) Int. Cl.

| | |
|---|---|
| ***A43B 11/00*** | (2006.01) |
| ***A43B 1/04*** | (2022.01) |
| ***A43B 23/04*** | (2006.01) |

(52) U.S. Cl.

CPC ..... *D04B 1/102* (2013.01); *D10B 2501/043* (2013.01)

(58) Field of Classification Search

CPC .. D04B 7/34; A43B 1/04; A43B 11/00; A43B 11/02; A43B 11/027; A43B 11/042

See application file for complete search history.

(56) References Cited

U.S. PATENT DOCUMENTS

| | | | | |
|---|---|---|---|---|
| 9,145,629 | B2 | 9/2015 | Podhajny | |
| 9,404,205 | B2 | 8/2016 | Meir | |
| 9,510,637 | B2 | 12/2016 | Podhajny et al. | |
| 10,172,422 | B2 | 1/2019 | Podhajny et al. | |
| 10,327,515 | B2 | 6/2019 | Peyton et al. | |
| 10,398,196 | B2 | 9/2019 | Minami et al. | |
| 11,447,899 | B2 * | 9/2022 | Berrian | A43B 11/00 |
| 2010/0154256 | A1 | 6/2010 | Dua | |
| 2012/0023778 | A1 | 2/2012 | Dojan et al. | |
| 2013/0239438 | A1 | 9/2013 | Shaffer et al. | |
| 2013/0263360 | A1 | 10/2013 | Thibodeau | |
| 2014/0068968 | A1 | 3/2014 | Podhajny et al. | |
| 2014/0196313 | A1 | 7/2014 | Hatfield et al. | |
| 2014/0237861 | A1 | 8/2014 | Podhajny | |
| 2014/0238083 | A1 | 8/2014 | Meir | |
| 2015/0143716 | A1 | 5/2015 | Long et al. | |
| 2015/0359290 | A1 | 12/2015 | Podhajny et al. | |
| 2016/0219983 | A1 | 8/2016 | Taylor | |
| 2018/0110283 | A1 | 4/2018 | Brinkman et al. | |
| 2018/0132558 | A1 | 5/2018 | Berrian et al. | |
| 2020/0385900 | A1 | 12/2020 | Berrian et al. | |

OTHER PUBLICATIONS

Extended European Search Report received for European Patent Application No. 23167418.5, dated Jul. 24, 2023, 10 pages.

* cited by examiner

UPPER INCLUDING A KNITTED COMPONENT

CROSS-REFERENCE TO RELATED APPLICATIONS

This application is a continuation of co-pending U.S. application Ser. No. 17/001,275, filed Aug. 24, 2020, and entitled "Upper Including a Knitted Component," which is a continuation of U.S. application Ser. No. 15/808,342, filed Nov. 9, 2017, and issued as U.S. Pat. No. 10,753,019 on Aug. 25, 2020, which claims the benefit of U.S. Provisional Application No. 62/421,850, filed Nov. 14, 2016. All applications listed in this paragraph are herein incorporated by reference in their entireties.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

BRIEF DESCRIPTION

In one aspect, the present disclosure provides an article, which may be an upper for an article of footwear in some embodiments. The article may include a knitted component with a first zone and a second zone adjacent to the first zone. The knitted component may include a tab element extending from the first zone, where the tab element and the first zone include a common yarn. The first zone may include a first elasticity and the second zone may include a second elasticity, where the first elasticity is less than the second elasticity.

The common yarn may be a floating yarn, where the floating yarn has a tenacity of at least 5 g/D.

The first zone may extend from the tab element to an edge in a heel region of the article. The zone may be configured to be located directly behind a heel of a user when the upper is incorporated into the article of footwear and when the article of footwear is in use.

The tab element may be flared such that a surface is oriented from 0° to 60° with respect to a plane parallel to the ground when the tab element is in a resting state.

A first side of the tab element may include at least 10% fewer courses per unit length than a second side when measured while the tab element is in a flattened state.

The knitted component may have a tongue with a top side and a bottom side, where the bottom side is formed from at least 30% more material than the top side such that the tongue has a tendency to curve in a direction corresponding to the top side.

In another aspect, the present disclosure provides an upper for an article of footwear. The upper may include a knitted component with a first zone. The knitted component may include a tab element extending from the first zone, where the tab element and the first zone include at least one common yarn. The at least one common yarn may include a floating yarn having a tenacity of at least 5 g/D.

The knitted component may include a second zone adjacent to the first zone, where the first zone includes an elasticity greater than an elasticity of the second zone. The second zone may be configured to be located directly behind a heel of a user when the upper is incorporated into the article of footwear and when the article of footwear is in use.

The floating yarn may have a floating portion with a length corresponding to at least 3 needles on a needle bed. The floating yarn may have a floating portion with a length corresponding to at least 8 needles on a needle bed.

The tab element may be flared such that a surface is oriented from 0° to 60° with respect to a plane parallel to the ground when the tab element is in a resting state.

A first side of the tab element may include at least 10% fewer courses per unit length measured when the tab element is in a flattened state.

The knitted component may include a tongue with a top side and a bottom side, where the bottom side is formed from at least 30% more material than the top side such that the tongue has a tendency to curve in a direction corresponding to the top side.

In another aspect, the present disclosure provides a method for forming an article. The method may include knitting a knitted component on a knitting machine, the knitted component including with a first zone and a second zone adjacent to the first zone, and the knitted component further including a tab element extending from the first zone. The tab element and the first zone may include a common yarn. The first zone may include a first elasticity and the second zone includes a second elasticity, where the first elasticity is less than the second elasticity.

The common yarn may be a floating yarn, where the floating yarn has a tenacity of at least 5 g/D.

The knitted component may be formed on a knitting machine during a single weft knitting process.

The article may be an upper for an article of footwear, and the first zone may be located in a heel region of the upper.

In another aspect, the present disclosure provides an upper with a knitted component, the knitted component including a knit tongue with a top side facing a first direction and an opposite bottom side, where the bottom side of the knit tongue is knitted with more material than the top side such that the tongue has a tendency to curve in the first direction.

DETAILED DESCRIPTION

Figure 1:
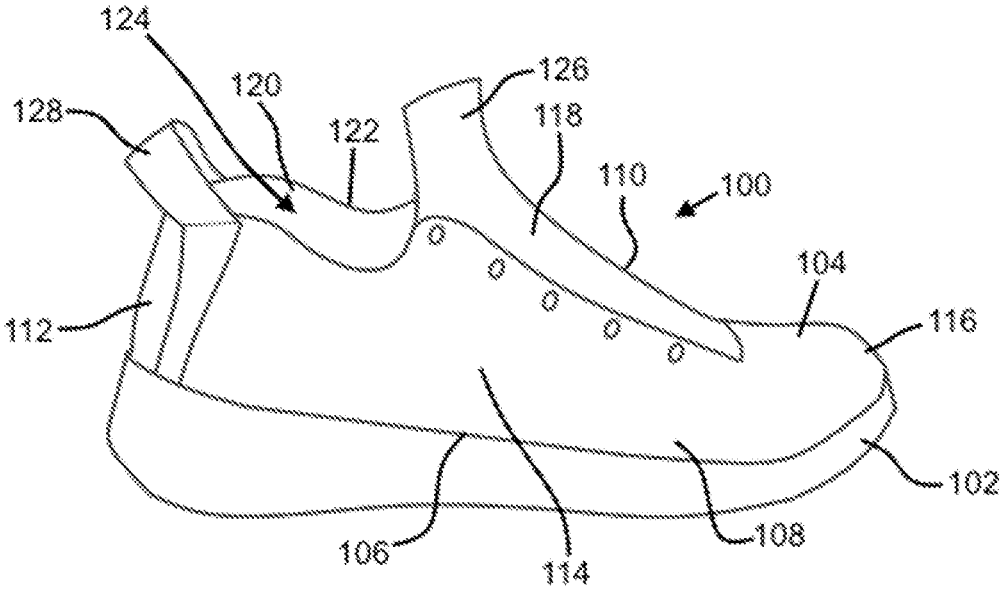
FIG. 1 shows an article of footwear with a tab element in accordance with the present disclosure.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

As shown in FIG. 1, an article of footwear 100 may include a sole 102 and an upper 104. The area where the sole 102 joins the outer edge of the upper 104 may be referred to as the biteline 106. The upper 104 may be joined to the sole 102 in a fixed manner using any suitable technique, such as through the use of an adhesive, bonding, sewing, etc. In some embodiments, the sole 102 may include a midsole and an outsole. It is contemplated that a separate sole 102 may be omitted and the upper 104 may comprise a lower surface that is configured to directly engage a ground surface.

The upper 104 may include a lateral side 108, a medial side 110, a heel region 112, a mid-foot region 114, and a toe region 116. The upper 104 may additionally include a throat 118 and an ankle opening 120, which may be surrounded by a collar 122. The upper 104 may define a void 124 of the article of footwear 100 that is configured to receive and accommodate the foot of a user or wearer. The throat 118 may generally be disposed in the mid-foot region 114 of the upper 104. The mid-foot region 114 is depicted as a section of the upper 104 located between the heel region 112 and a toe region 116. In FIG. 1, a tongue 126 is optionally disposed in the throat 118 of the article of footwear 100. The tongue 126 depicted in FIG. 1 is a traditional tongue, but the tongue 126, if included, may be any suitable type of tongue, such as a gusseted tongue or a burrito tongue. If a tongue is not included, the lateral and medial sides of the throat 118 may be joined together, for example.

In some embodiments, the upper 104 or other article (e.g., an article of apparel) may additionally or alternatively include a tab element 128. The tab element 128 may be located in the heel region 112 of the upper 104, for example, and may be located adjacent to the collar 122. Advantageously, the tab element 128 may be pulled by a user to facilitate placing a foot in the void 124 of the upper 104. The tab element 128 is depicted as including a strap or central portion with two ends secured to the heel region 112 of the upper 104, but the tab element 128 may additionally or alternatively include another suitable structure (such as a tab with only one end secured to the heel region 112 of the upper 104, for example).

Figure 2:
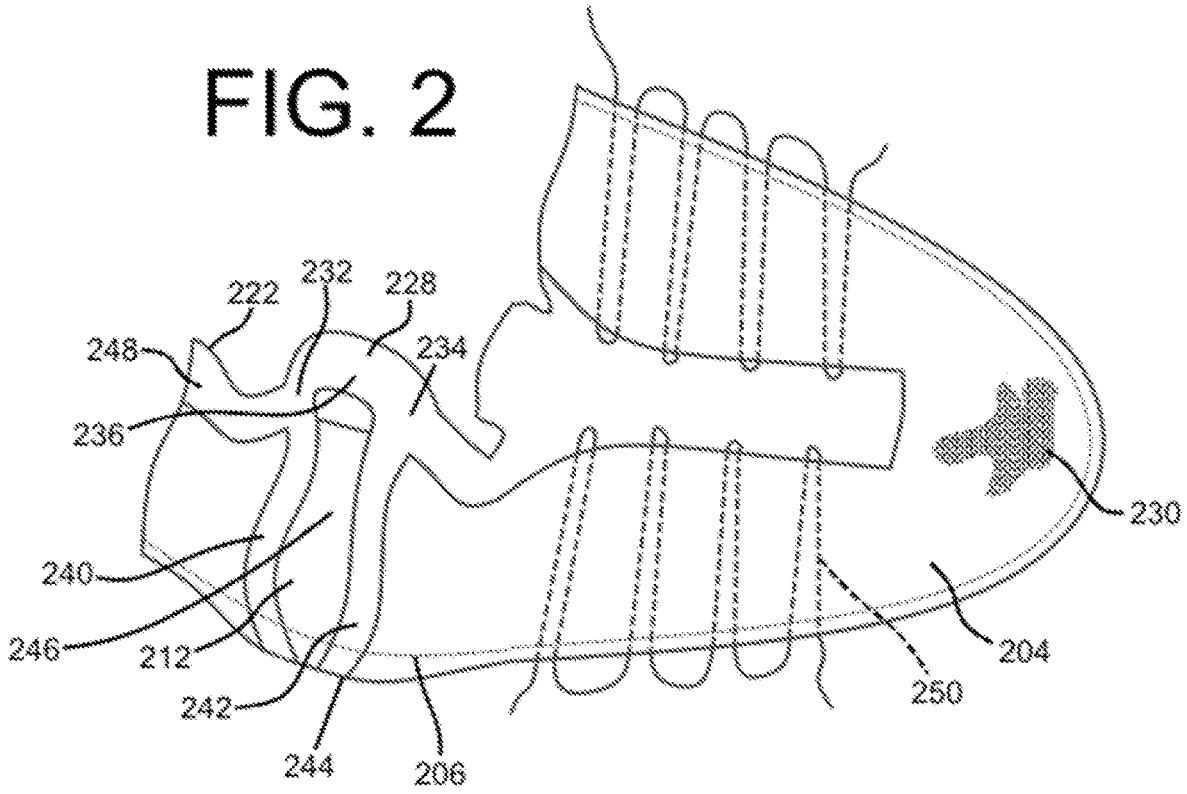
FIG. 2 shows an upper with a knitted component including a tab element in accordance with the present disclosure.

FIG. 2 shows an upper 204 in isolation. As shown, the upper 204 may be formed at least partially of a knitted component 130. For example, the upper 204 may be at least partially formed by a continuous and integral knitted component 130, and in some embodiments the knitted component 130 may substantially form the entirety of the upper 204. It is contemplated that the knitted component 130 may be manufactured as an integral one-piece element during a single process, such as a single weft knitting process (e.g., with a flat knitting machine or circular knitting machine), a single warp knitting process, or any other suitable knitting process. Alternatively, the knitted component 130 may be formed of a plurality of individual pieces (where each of the plurality of pieces may be knitted), where the individual pieces are assembled together (e.g., by sewing), after the knitting process.

As shown in FIG. 2, the upper 204 may include tensile strands 250 that associate with a fastening element (e.g., a shoelace). The tensile strands 250 are an optional component and may form lace loops or apertures to receive a lace or another fastening element. A tensile strand may be a yarn, a cable, a rope, or any other type of strand or elongated element. A tensile strand may be flexible, but it also may have a substantially fixed length measured from a first end to a second end. As such, the tensile strand can be substantially inelastic. The one or more tensile strands 250 may extend across and/or along the upper 204 in any direction. The tensile strands may limit the stretch of the knitted component. The tensile strands 250 may preferably be inlaid within the intermeshed loops of the knitted component 230, but it is contemplated that portions of the tensile strands may be exposed from the knitted component. See, for example, U.S. Patent Application Publication No. 2015/0359290, U.S. Patent Application Publication No. 2014/0237861, and U.S. Pat. No. 9,145,629, which are incorporated into the present application in their entirety.

As shown in FIG. 2, a tab element 228 (similar to the tab element 128 of FIG. 1) may be a portion of the knitted component 130 and may share at least one common yarn and/or at least one common course with a heel region 212. The tab element 228 may include a first end 232, a second end 234, and a central portion 236. The first end 232 and the second end 234 may be adjacent to the point at which the yarn forming the tab element 228 begins to intermesh with the loops forming the heel region 212 of the knitted component 230. In some exemplary embodiments (which are non-limiting), the central portion 236 of the tab element 228 may, when measured from the first end 232 to the second end 234 around the tab element 228, have a length of between about 2 mm to about 100 mm (such as about 30 mm to about 65 mm, and more particularly about 50 mm when used as a tab element, though other sizes are contemplated for other functions). The central portion 236 may be unsecured from the heel region 212 (and therefore also the intermeshed loops defining the heel region 212) along its longitudinal length. Further, the central portion 236 may include its own intermeshed loops (e.g., which are formed on a knitting machine), which are separate from the intermeshed loops forming the heel region 212. Alternatively (or in addition), the tab element 228 may include one or more yarns extending from the first end 232 to the second end 234 without intermeshed loops.

Advantageously, one or more fingers of a user (or other object) may be placed in the opening (or aperture) between the central portion 236 of the tab element 228 and the surface of the heel region 212 such that a user can pull or otherwise provide a force to the tab element 228. It is also contemplated that the opening (or aperture) could be located in another location and configured to receive another object, such as a shoelace (e.g., when the tab element 228 is located in a throat area and configured to receive a lace, for example). When located in the heel region 212, the force applied to the tab element may thereby locate the heel region 212 of the upper 204 into proper position with respect to a wearer's foot. Alternatively or in addition, the tab element 228 may function as, and include all aspects of, a "first structure" as disclosed in U.S. Provisional Patent Application No. 62/411,633, filed Oct. 23, 2016, and U.S. patent application Ser. No. 15/789,804, filed Oct. 20, 2017, which are both herein incorporated by reference in their entireties. Each of the features and aspects disclosed herein with respect to a tab element may also apply with respect to the "first structure" of those applications.

The upper 204 may further include at least one zone (see, e.g., the first zone 240, the second zone 246, and the third zone 242) with elasticity, strength, durability, and/or other characteristics suitable to distribute or transfer a force applied to the tab element 228. Referring to FIG. 2, the first zone 240 may extend from the first end 232 of the tab element 228 to an edge 244 of the upper and the third zone 242 may extend from the second end 234 of the tab element 228 to the edge 244 of the upper 204. While not required, the first zone 240 and the third zone 242 may be respectively located on the medial and lateral sides of the second zone 246 that is configured to be positioned directly behind the heel of a wearer. The first zone 240 and the third zone 242 may be relatively inelastic when compared to another area of the article of footwear, such as the second zone 246. Advantageously, the first zone 240 and/or the third zone 242 may be configured to direct a force applied to the tab element 228 to a particular location (such as to the edge 244), and having the relatively elastic second zone 246 may be advantageous for gripping the heel of a wearer and for providing comfort at the heel (which is a principle area of contact between the upper 204 and the foot, and also a common area where discomfort may occur). At least one additional zone 248 may be located at the collar 222 or in other locations and may be relatively elastic when compared to the first zone 240 and/or the third zone 242 to provide a snug fit at the entrance of the void 224. Relative elasticities of the zones (and also of different knitted components) may be determined by applying a known tensile force (e.g., on a tensometer) to the respective zones (or components) and then measuring the degree of stretch or displacement. For example, when one zone or component stretches twice as much under as another under the same tensile force (e.g., 20 pounds), it is said to have twice the elasticity.

When the present embodiment of the upper 204 is incorporated into an article of footwear, for example, the first zone 240 and/or the third zone 242 may extend to beneath a biteline (which may be located at the reference line 206) such that a force applied to the tab element 228 is directed to a location where the upper 204 is secured to a sole structure. To enhance the securement, at least one of the first zone 240 and the third zone 242 may be individually secured to a sole structure (e.g., by sewing, by use of an adhesive, by use of a mechanical clamp, or by any other suitable means). Further, it is contemplated that the edge 244 of the upper 204 may extend such that it is located under the foot of a wearer when the article of footwear is in use such that the weight of the wearer enhances the securement of the edge 244 (by, e.g., increasing the static friction force between the first zone 240 and/or the third zone 242 with respect to the sole structure, for example).

To provide suitable strength and durability, the first zone 240, the third zone 242, and/or the tab element 228 may include a particular yarn, such as a yarn formed using a synthetic polymer fiber. Types of yarn which can be formed using synthetic polymer fibers include filament yarns (including monofilament yarns) and spun yarns. Synthetic polymer filament yarns are formed of continuous elongated filaments which can be twisted or grouped together. Monofilament yarns are formed of a single elongated, continuous filament of a synthetic polymer material. Spun yarns are made by twisting staple fibers together to make a cohesive strand. The process of forming a yarn from staple fibers typically includes carding and drawing the fibers to form sliver, drawing out and twisting the sliver to form roving, and spinning the roving to form a strand. Multiple strands can be plied (twisted together) to make the spun yarn thicker. The twist direction of the staple fibers and of the plies can affect the final properties of the yarn.

Synthetic polymer spun yarns can be formed using a single type of fiber, such as a single type of synthetic polymer fiber, by using a blend of more than one type of synthetic polymer fiber, as well as by using blends of one or more type of synthetic polymer fibers with natural and/or regenerated fibers. Similarly, synthetic polymer continuous filament yarns can be formed from continuous filaments of a single type of synthetic polymer, can be formed from continuous filaments formed from more than one type of synthetic polymer, or can be formed from a combination of continuous fibers formed from a regenerated material with synthetic polymer continuous filaments formed of one or more types of synthetic polymers. Once formed, filament and spun yarns can undergo further treatments such as dyeing, texturizing, or coating with a material such as a synthetic polymer, in order to alter the properties of the yarn. One way to characterize a yarn is based on its mass density or weight per unit length. The linear mass density or weight per unit length of a yarn can be expressed using various units, including denier (D) and tex. Denier is the mass in grams per 9000 meters. The linear mass density of a single filament of a fiber can also be expressed using denier per filament (DPF). Tex is the mass in grams per 1000 meters; decitex (dtex) is the mass in grams per 10,000 meters.

Tenacity is another way to characterize a yarn. As used herein, "tenacity" is understood to refer to the amount of force (expressed in units of weight, for example: pounds, grams, centinewtons or other units) needed to rupture a yarn (i.e., the breaking force or breaking point of the yarn), divided by the linear mass density of the yarn expressed, for example, in (unstrained) denier, decitex, or some other measure of weight per unit length. The amount of force needed to break a yarn (the "breaking force" of the yarn) is determined by subjecting a sample of the yarn to a known amount of force by stretching the sample until it breaks, for example, by inserting each end of a sample of the yarn into the grips on the measuring arms of an extensometer, subjecting the sample to a stretching force, and measuring the force required to break the sample using a strain gauge load cell. Suitable testing systems can be obtained from Instron (Norwood, Mass., USA). Yarn tenacity and yarn breaking force are distinct from burst strength or bursting strength of a textile, which is a measure of the maximum force that can be applied to the surface of a textile before the surface bursts.

Generally, in order for a yarn to withstand the forces applied in an industrial knitting machine, the minimum tenacity required is approximately 1.5 grams per denier (g/D). Most synthetic polymer continuous filament yarns formed from commodity polymeric materials generally have tenacities in the range of about 1.5 g/D to about 4 g/D. For example, polyester filament yarns that may be used in the manufacture of knit uppers for article of footwear have tenacities in the range of about 2.5 g/D to about 4 g/D. Filament yarns formed from commodity synthetic polymeric materials which are considered to have high tenacities generally have tenacities in the range of about 5 g/D to about 10 g/D. For example, commercially available package dyed polyethylene terephthalate filament yarn from National Spinning (Washington, N.C., USA) has a tenacity of about 6 g/D, and commercially available solution dyed polyethylene terephthalate filament yarn from Far Eastern New Century (Taipei, Taiwan) has a tenacity of about 7 g/D. Filament yarns formed from high performance synthetic polymer materials generally have tenacities of about 11 g/D or greater. For example, filament yarns formed of aramid typically have tenacities of about 20 g/D, and filament yarns formed of ultra-high molecular weight polyethylene (UHMWPE) having tenacities greater than 30 g/D are available from Dyneema (Stanley, N.C., USA) and Spectra (Honeywell-Spectra, Colonial Heights, Va., USA).

In exemplary embodiments, the first zone 240, the third zone 242, and the tab element 228 may be at least partially formed (e.g., knitted) using at least one high tenacity yarn with a tenacity of at least about 5 g/D and potentially in the range of about 5 g/D to about 10 g/D, or higher (such as 20 g/D or higher). Other yarns, such as a polyester yarn with a relatively low tenacity but with other desirable properties (e.g., softness for comfort and cushioning, relatively high elasticity, and/or desirable bonding characteristics), may additionally be included. The high tenacity yarns may provide the upper 204 with the ability to receive a relatively high force at the tab element 228 (e.g., when a wearer pulls while putting the article of footwear on) without breaking or otherwise becoming damaged. As described above, such a force may be directed to another area capable of withstanding that force by the first zone 240 and/or the third zone 242.

Figure 2A:
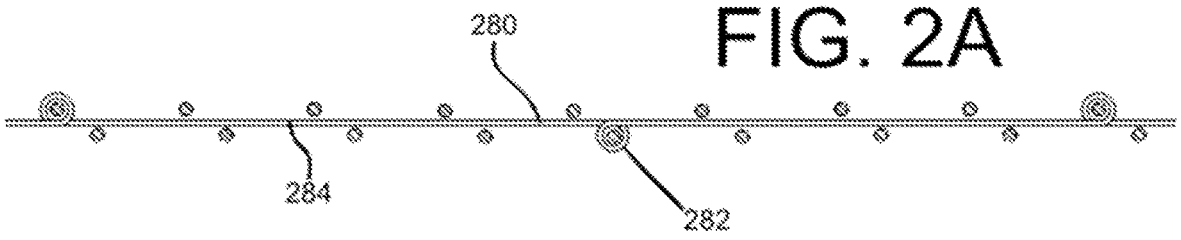
FIGS. 2A-2B show a portion of a knitting sequence for including a floating yarn in a knitted component in accordance with the present disclosure.

It may be advantageous to provide high tenacity yarns in one of the first zone 240, the third zone 242, and the tab element 228 as an inlaid and/or floating yarn. For example, as shown in FIG. 2A, a yarn 280 (which is preferably a high tenacity yarn with a tenacity of at least 5 g/D, such as at least 7 g/D, such as 10 g/D or higher, but may optionally be another type of yarn) may have loops 282 and floating portions 284 extending between the loops 282. The floating portions 284, which do not include loops (but may pass by or through other loops formed by other yarns in an adjacent course), may be relatively straight and nearly taught when incorporated into a knitted component such that they limit elasticity of the knitted component in the longitudinal direction (defined by the longitudinal axis of the yarn 280). The loops 282 may allow for some extension of the yarn 280 in the longitudinal direction, but once the loops 282 are taught, the yarn 280 may lock (i.e., prevent further elongation) the knitted component with respect to the longitudinal direction. Accordingly, the yarn 280 may be configured (e.g., have a particular number of loops situated in particular locations) to provide a suitable locking effect in at least one zone of the knitted component, such as the first zone 240, the third zone 242, and/or the tab element 228 of FIG. 2. The "locking effect" may be a point (e.g., a degree of stretch) where the rigidity of the yarn 280 substantially increases. That is, prior to the locking effect taking place (e.g., when a force less than that required to reach the "locking effect" is applied), the stretchability may be at least 100% greater than (such as 200%, 300%, 500% or more) the same yarn's stretchability after the locking effect takes place. This so-called locking effect may occur where "slack" or relative looseness in the loops 282 becomes taught.

Figure 2B:
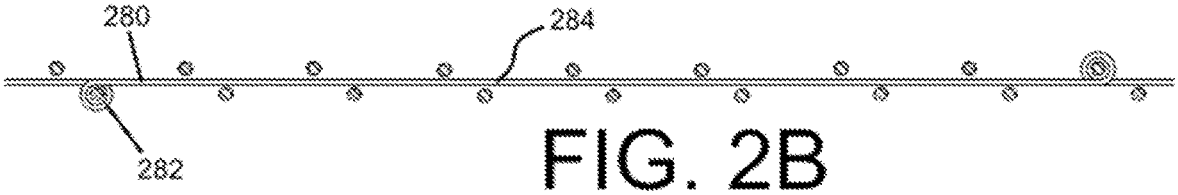

The floating portions 284 of the yarn 280 may have any suitable length. In exemplary embodiments, the floating portions 284 may have a length corresponding to between about 3 needles on a needle bed (as shown in FIG. 2A) to about 30 needles on a needle bed, such as about 5 needles on a needle bed to about 15 needles on a needle bed, and more particularly 8 needles on a needle bed (as shown in FIG. 2B). In a completed (formed) knitted component, one skilled in the art may be able to determine how many needles the length corresponds to by evaluating how many loops of an adjacent course formed by another yarn the floating portions 284 pass by. Further, the length of the floating portion 284 relative to the number of loops 282 may correspond with the maximum elongation of the knitted component prior to the locking effect taking place (that is, the fewer loops of the yarn 280 relative to its length, the less it may elongate prior to the locking effect taking place). When, for example, the first zone 240 includes a floating yarn extending along its length, the first zone 240 may be capable of increasing its length by about 1% to about 20% when subjected to a force and prior to the locking effect taking place, such as about 2% to about 5% (e.g., about 3% in an exemplary embodiment). Advantageously, when a user pulls on the tab element 228 of FIG. 2, the user may feel a slight elongation of the upper 204 when the force is initiated (e.g., prior to the locking effect taking place, and this "give" may be desirable for comfort purposes), and then, once the locking effect occurs, little additional elongation may occur even upon an increase in the applied force, which may allow for precise control and instant reaction of the upper 204.

Figure 3:
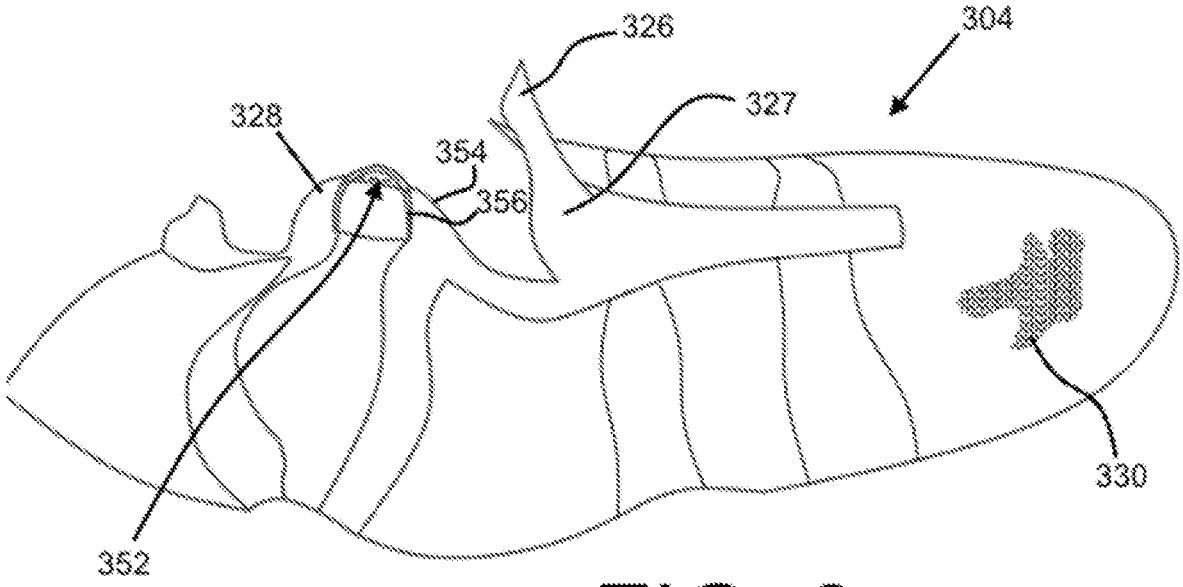
FIG. 3 shows a perspective view of an upper with a knitted tab element and knitted zones in accordance with the present disclosure.

As illustrated in FIG. 3, a knitted upper 304 (which may be knitted as one piece during a single knitting process) may have a tab element 328 that may be shaped such that a bottom surface 352 is oriented at an angle towards the ground when the upper 304 is incorporated into an article of footwear. For example, a bottom surface 352 of the tab element 328, which may be the surface typically contacted by the fingers of a wearer when the wearer applies a force to the tab element 328, may be oriented in such a way as to distribute that force across the entirely of the bottom surface 352 to thereby limit the maximum force experienced at any one location. Advantageously, since the force is spread over a relatively large area, discomfort and/or injury to the wearer (and particularly the wearer's fingers) may be prevented.

The shape of the tab element 328 may be formed during the knitting process and without significant post-processing steps. In one embodiment, when the tab element 328 is formed, a first side 354 may be knitted with fewer courses than a second side 356 (or, at least fewer courses per unit length measured when the knitted component is forced into a flattened state). For example, the first side 354 may have about 10% to about 50% fewer courses per unit length, such as about 30% fewer courses per unit length, than the second side 356. In some embodiments, the first side 354 and the second side 356 may have about the same total number of courses even when the first side 354 would have a greater length if the tab element 328 was forced into a flattened state. As a result, if held flat, the yarns on the first side 354 of the tab element 328 may experience a tension and/or the yarns forming the second side 356 of the tab element 328 may experience a compression. Accordingly, when free from external forces, the tab element 328 may have a natural tendency to curl away from the first side 354 and towards the second side 356, thereby causing the tab element 328 to flare as shown in FIG. 3. As the tab element 328 flares, the surface 352 will become oriented towards the ground. The degree of this tendency to flare may be controlled by controlling the difference in the number of courses between the first side 354 and the second side 356. When free of external forces (i.e., in a resting state) and when incorporated into an article of footwear placed on flat ground, it is contemplated that an area of the surface 352 at the apex of the tab element 328 may be oriented at an angle of about 0° to about 60° with respect to a plane parallel to the ground, such as an angle of about 10° to about 30°.

The flared tab element 328 may be advantageous for providing the surface 352 with a desirable orientation. For example, the orientation of the surface 352 may correspond with a typical orientation of a finger of a user when a user pulls on the tab element 328. Accordingly, the surface area of contact between the surface 352 and the finger may be relatively large when compared to an un-flared tab element. The larger surface area of contact may reduce discomfort by widening the distribution of the force on the finger. It is contemplated that the surface 352 may include certain yarns suitable for comfort on contact, such as polyester yarns.

Similarly, it is contemplated that the tongue 326 (or another area of the knitted component 330) may include a knit structure at an area 327 for providing a tendency to form a curved surface. For example, in areas where the knitted component is formed on two needle beds of a knitting machine, substantially more material (e.g., more yarns and/or courses) may be associated with one side of knitted component than the other side (as measured by the surface area of yarns associated with each side). This may be accomplished by providing more yarns and/or courses on one needle bed than the other such that one side may have substantially more loops than the other side. Advantageously, the embodiment of FIG. 3 may provide a knitted tongue 326 that curves upwards when incorporated in an article of footwear such that it does not obstruct the void 324 prior to the insertion of a foot and, for example, to provide the article of footwear with an orientation exhibiting a desirable aesthetic appearance even when the article of footwear is not in use. For example, when lying flat (e.g., prior to the knitted component being shaped into a wearable shape) on the ground and when free from external forces, an end of the tongue 326 may be oriented at least at a 20° angle with respect to the ground, such as at least 30°, and more particularly at least 45°. Thus, when incorporated into an article of footwear, the tongue 326 may be angled at least 20°, 30°, or even 45° or more with respect to a portion of the throat 118 located closer to the toe region 116 (see FIG. 1).

Figure 4:
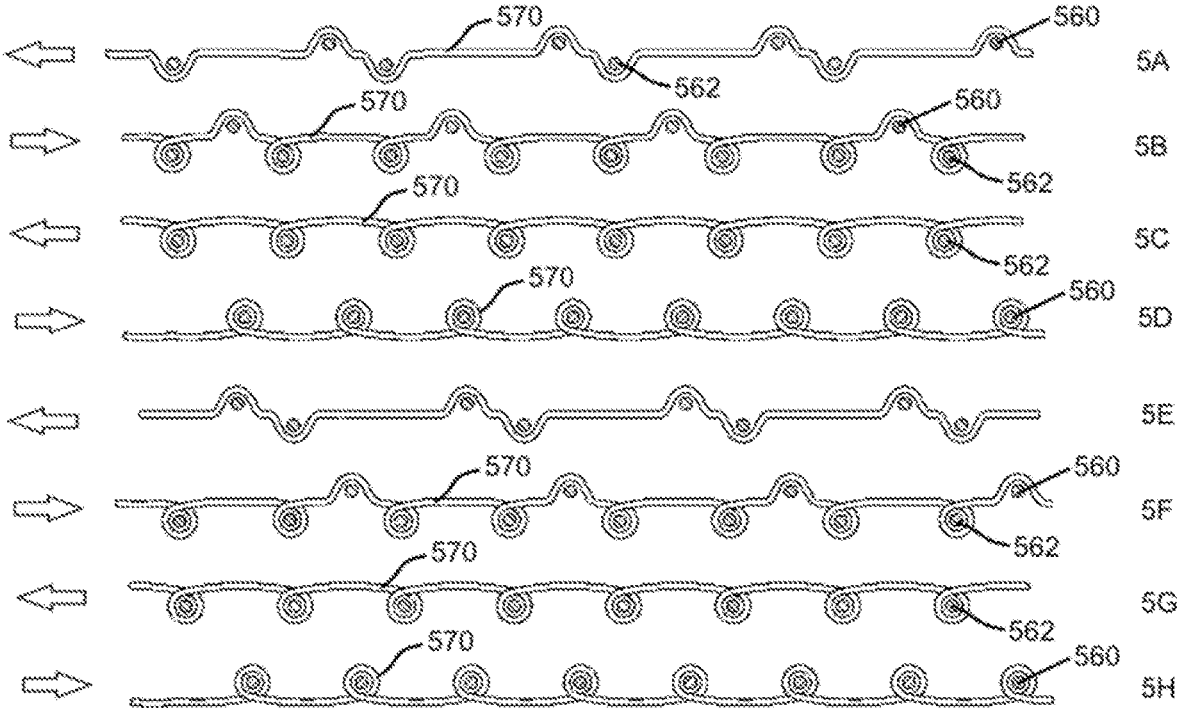
FIG. 4 shows a knit diagram for forming a shaped knitted component in accordance with the present disclosure.

One sequence that may be used to form a knitted component with a tendency to curve is shown in FIG. 4. The sequence of FIG. 4 is depicted as involving only a single yarn (depicted as the yarn 570), although multiple yarns could be used. Two or more of the steps 5A-5H may involve a single yarn or multiple yarns with different characteristics. Some of the yarns, and potentially all of the yarns used in this sequence, may include a polyester material. Further, more than one yarn may be involved at each step of the sequence, and each yarn may be selected with certain properties to select particular characteristics of the knitted component.

In FIG. 4, the depicted series of needles on the front needle bed 562 may be associated with the top side of the tongue 326 of FIG. 3 and the depicted series of needles on the back needle bed 560 may be associated with a bottom side of the tongue 326. Step 5A represents a pass in the left direction, where a tuck is performed at every other needle on the front needle bed 562 and at every other needle on the back needle bed 560 (note that the unoccupied needles are not shown in FIG. 4). In some embodiments, a tuck at 1 out of 3 needles, 2 out of 3 needles, or another fraction of needles could be used during this step instead. In step 5B, now passing to the right, a loop is formed on each of the needles of the front needle bed 562 and a tuck is performed at every other needle of the back needle bed 560. As shown in step 5B, the tucks during this pass may be performed on every opposite needle with respect to the tucks of the pass represented by step 5A. The loops formed on the front needle bed 562 in step 5B may form a portion of the outer surface of the knitted component 330 (of FIG. 3). Step 5C, now passing again to the left, involves a loop on every needle of the front needle bed 562, and step 5D, passing to the right, involves a loop on every needle of the back needle bed 560.

Referring to the loops formed in the sequence illustrated by FIG. 4 (i.e., 8 passes performed over a series of 8 needles on the front needle bed 562 and a corresponding series of 8 needles on the back needle bed 560), 32 loops are formed on the front needle bed 562 while only 16 loops are formed on the back needle bed 560. Accordingly, substantially more material and substantially more loops may form the bottom side of the tongue 326 with respect to the top side. In some embodiments, about 10%, 20%, 30%, 40%, 50%, 60%, or even 70% or more material and/or more loops may be associated with one side of the knit element 530 than the other. As a result of additional material and additional loops on the bottom side of the tongue 326 (of FIG. 3), if forced into a flattened state, the bottom side of the tongue 326 may be relatively compressed (when compared to the top side) and the top side of the tongue 326 may be relatively tensioned such that the tongue 326 has a tendency to form and retain a curved shape (as shown in FIG. 3). Optionally, the tendency to curve may be amplified through certain post-processing steps such as steaming, which may, for example, tighten the yarns of the knitted component 330, which may increase the effect of a disparity between the amounts of material forming the top and bottom sides.

All of the structures and methods disclosed and claimed herein can be made and executed without undue experimentation in light of the present disclosure. While this disclosure may be embodied in many different forms, there are described in detail herein specific aspects of the disclosure.

The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. An upper, comprising:

a first zone, a second zone, and a third zone, wherein each of the first zone, the second zone, and the third zone extend toward a collar of the upper, wherein the first zone, the second zone, and the third zone are each located at least partially in a heel area of the upper, wherein the second zone is located between the first zone and the third zone such that the second zone is located in a substantially central portion of the heel area, and wherein the first zone and the third zone each comprise a first elasticity, wherein a portion of the second zone positioned below the collar comprises a second elasticity, and wherein the second elasticity is greater than the first elasticity.

2. An article of footwear comprising the upper of claim 1 and a sole structure, wherein the first zone, the second zone, and the third zone extend at least from a biteline of the article of footwear to the collar.

3. The upper of claim 1, wherein at least a portion of the first zone extends toward the third zone.

4. The upper of claim 1, wherein the heel area further comprises a tab portion.

5. The upper of claim 4, wherein the tab portion comprises an opening.

6. The upper of claim 1, wherein the upper comprises a knitted component.

7. An upper, comprising:

a heel area having a first zone, a second zone, and a third zone extending toward a collar of the upper, wherein the second zone is located between the first zone and the third zone such that the second zone is located in a substantially central portion of the heel area, and wherein the second zone comprises a higher degree of elasticity than the first zone and the third zone below the collar.

8. The upper of claim 7, wherein at least a portion of the first zone extends toward the third zone.

9. The upper of claim 7, wherein the heel area further comprises a tab portion.

10. The upper of claim 9, wherein the tab portion comprises an opening.

11. The upper of claim 7, wherein the upper comprises a knitted component.

12. The upper of claim 7, wherein the first zone, the second zone, and the third zone extend at least from a bite line of the article of footwear comprising the upper.

13. An article of footwear, comprising:

an upper having a first zone, a second zone, and a third zone extending from at least a biteline toward a collar area of the upper in a heel area, wherein the second zone is located between the first zone and the third zone such that the second zone is located in a substantially central portion of the heel area, and wherein the second zone comprises a higher degree of elasticity than the first zone and the third zone at least proximate to the biteline of the article of footwear; and a sole attached to at least a portion of the upper at the biteline.

14. The article of footwear of claim 13 wherein the upper comprises a knitted component.

15. The article of footwear of claim 13, wherein the heel area further comprises a tab portion.

16. The article of footwear of claim 15, wherein the tab portion comprises an opening.

* * * * *